United States Patent [19]

Biermann et al.

[11] Patent Number: 4,607,583

[45] Date of Patent: Aug. 26, 1986

[54] CUTTING DEVICE IN A SEWING MACHINE FOR CUTTING AT LEAST ONE THREAD CHAIN OR A SEWN-ON TAPE

[75] Inventors: Kurt Biermann; Gerhard Steppat; Bodo Wehmeyer, all of Bielefeld, Fed. Rep. of Germany

[73] Assignee: Durkoppwerke GmbH, Bielefeld, Fed. Rep. of Germany

[21] Appl. No.: 689,701

[22] Filed: Jan. 8, 1985

[30] Foreign Application Priority Data

Jan. 11, 1984 [DE] Fed. Rep. of Germany ..... 3400697

[51] Int. Cl.[4] ..... D05B 37/04; D05B 65/00

[52] U.S. Cl. ..... 112/130; 112/288; 112/294

[58] Field of Search ..... 112/130, 288, 292, 294

[56] References Cited

U.S. PATENT DOCUMENTS

| | | | |
|---|---|---|---|
| 2,095,647 | 10/1937 | Mann | 112/130 |
| 2,354,491 | 7/1944 | Valentine | 112/130 |
| 3,163,136 | 12/1964 | Dickett | 112/130 |
| 3,487,798 | 1/1970 | Marforio | 112/130 |
| 3,848,555 | 11/1974 | Boser | 112/288 |
| 3,857,346 | 12/1974 | Dal Negro | 112/130 |
| 3,938,454 | 2/1976 | Boser | 112/130 |
| 4,075,954 | 2/1978 | Hintzen et al. | 112/130 |

*Primary Examiner*—Werner H. Schroeder
*Assistant Examiner*—Joseph S. Machuga
*Attorney, Agent, or Firm*—Ostrolenk, Faber, Gerb & Soffen

[57] ABSTRACT

A cutting device for cutting the thread chain, or the like, between successive sewn parts moving along a path through a sewing machine. The sewing machine includes a needle. A holder downstream of the needle includes a horizontal cutout. A hook for lifting the thread chain between adjacent sewn parts on the path is movable up through the cutout for raising the thread chain. A scissors moves across the sewn part path and cuts the upraised thread chain. The holder holds the upstream sewn part from shifting while permitting the downstream sewn part to shift slightly upstream as the hook rises and prior to the cutting, whereby a single cut cuts the thread chain adjacent both sewn parts. A sensor senses the trailing edge of a sewn part and activates a stitch counter to cause the needle to apply a predetermined number of stitches before halting sewing so that the cutting can thereafter take place.

12 Claims, 4 Drawing Figures

CUTTING DEVICE IN A SEWING MACHINE FOR CUTTING AT LEAST ONE THREAD CHAIN OR A SEWN-ON TAPE

BACKGROUND OF THE INVENTION

The present invention relates to a cutting device for cutting the thread chain, tape or the like, which joins successive sewn parts, and particularly for cutting near each of the sewn parts with one cutting.

A cutting device for threads or for the thread chain of sewn parts being worked on sewing machines is known from Federal Republic of Germany Pat. No. 10 65 704. In this publication, a scissors is located below the resting surface of the sewn material. The scissors includes two blades which are swingable around a common fixed pivot point. The scissors is moved upward in the direction toward the sewing place and thereby cuts the thread chain. This cutting device has a disadvantage. If the thread chain is to be cut close to the adjacent edges of two neighboring pieces of sewn material, which edges extend transversely to the sewn seam, then two cuts are required. One cut is made close to the sewn material edge of one of the adjacent sewn material parts and the other close to the edge of the other parts. Only if the thread chain which connects the adjacent sewn parts has a short length, amounting to only a few millimeters, is a single cut sufficient. Dependable cutting of the thread chain is not possible if the adjacent edges of the sewn material, beyond which the thread chain has been sewn, do not extend practically at right angles to the direction of transport of the sewn material through the sewing machine. When there is a relatively short thread chain, the sewn parts overlap in the region of the said sewn material edges. The tips of the upwardly moving scissor blades press against the overlapped material and thereby shift them upward along with the thread chain. As a result, cutting of the thread chain is prevented. The known cutting device has a further disadvantage that the scissors and their actuating members are arranged below the place of sewing. In modern high-speed sewing machines, the region around the looper or loopers has scarcely any free space for the arrangement of other structural parts like the scissors and their actuating members.

SUMMARY OF THE INVENTION

The invention has as its object the provision of a cutting device which avoids the disadvantages of the known cutting device and which cuts the thread chain or the sewn-on tape that joins two adjacent sewn parts close to both of the adjacent sewn material edges using only one cut.

The invention concerns a cutting device for use in a sewing machine, wherein the cutting device cuts a thread chain, sewn-on tape between two successive sewn parts, or the like. The sewn together parts move along a path through the sewing machine. The sewing machine includes a sewing needle which moves vertically up and down and performs a sewing process. The cutting device comprises cutting means which are supported on the sewing machine and are movable generally in the direction laterally across the path of the sewn parts through the sewing machine. The cutting means are operable for cutting the thread chain, or the like, in the vicinity of the sewing place, where the needle sews, and also quite close to the edges of the joined sewn parts. The cutting device includes a sensor, which may be of the conventional optical variety, a feeler, or the like, which scans the sewn parts as they move past and locates an edge of one of the sewn parts, and particularly the trailing edge of a sewn part. There is a stitch counter connected with the needle and with the sensor, and the stitch counter starts operation after the sensor senses the edge of a sewn part. Following a preselected number of stitches, the stitch counter halts the sewing needle operation, and the sewn parts are in position for cutting the thread chain.

Downstream of the sewing place, there is a holder for the sewn parts. That holder is movable up and down above the sewn parts, and thereby across their path of travel. The holder has a cutout, in the form of a notch in the holder, which extends transversely across the pathway of the sewn parts. The cutout is defined by a leading wall and a trailing wall in the holder with respect to the path of travel.

There is a thread engaging hook which is movably supported for movement up and down across the path of travel of the sewn parts and which is oriented to move through the cutout. The hook engages a thread chain, or the like, then over the cutout upon upward motion of the hook, and raises the thread chain upwardly for enabling the subsequent cutting. Subsequent to the raising of the thread chain, the cutting means is operated and the thread chain is cut.

Downstream of the cutout in the holder is positioned a sewn material transport means, e.g. a driven roller, which engages the sewn parts and moves them further downstream. It includes an intermittent drive for intermittent driving motion of the sewn parts along the path of travel.

Upstream of the cutout in the holder, the holder is movable against the sewn part there for holding it against moving along the path of travel as the hook is raised. On the other hand, downstream of the sewn part, the holder does not press down upon the sewn part to prevent it from moving, and the sewn part downstream of the cut-out can be shifted upstream toward the cutout as the hook is raised. This brings the adjacent edges of two adjacent sewn parts closer together, so that the subsequent single cutting operation will cut the thread chain near the adjacent edges of both of the adjacent sewn parts.

The cutting means comprises a scissors whose blades are supported on a pivot which has an orientation toward the vertical.

The cutting device of the invention can be used for sewn-material edges which extend obliquely to the direction of transport of the sewn material, like those found primarily in the case of sewn parts having a curved longitudinal edge, for instance, side-pocket entrances on jeans or armholes of sleeveless dresses which are provided with hem tape or with facing tape. The invention can be used to cut the thread chain or the hem or facing tape in the direct vicinity of the edges of the sewn material of the two adjacent sewn parts by means of a single cut.

Other objects and features of the invention will be apparent from the following description of one embodiment of the invention considered with the accompanying drawings.

DESCRIPTION OF A PREFERRED EMBODIMENT

Figure 1:
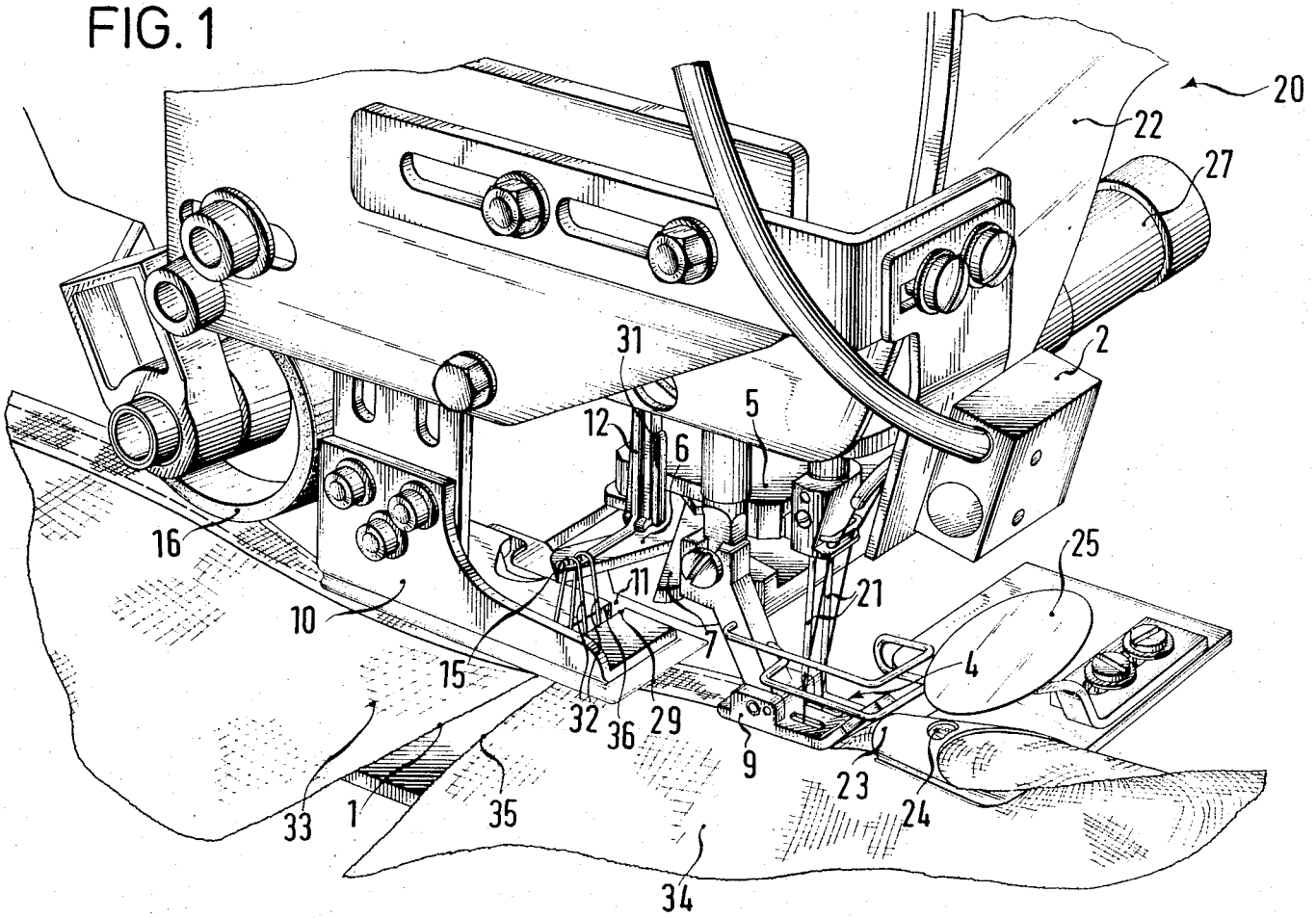
FIG. 1 is a perspective view of the cutting device of the invention shortly before cutting through the thread chain which has already been pulled upward.

The invention is shown in use on a lockstitch or double chain stitch sewing machine 20 of ordinary construction, which is provided with at least one sewing needle 21. A sensor 2 is arranged, on the arm head 22 of the sewing machine upstream of the sewing needle 21 in the path of the sewn material, for sensing the passing edge of the sewn material. When the edge has been sensed by the sensor 2, a preadjustable stitch counter 3 is started. The counter is preferably integrated in a control device, which forms part of the positioning drive. Thus, after the sensor recognizes the edge 1 of the sewn material, a preselectable number of stitches is sewn until the sewing is brought to a halt.

Directly upstream of the sewn material presser foot 9 of the sewing machine, there is a known edge folding, hem folding, or the like, apparatus 23, which the sewn part passes through. The straight or curved longitudinal edge of the sewn part is folded, seamed or hemmed. The apparatus 23 has a hole 24 opening into it, which permits scanning of the trailing edge 1 of the sewn material by the sensor 2. That sensor is preferably a light barrier. In order to prevent the moving fingers of the machine operator from unintentionally interrupting the beam of light emitted by the transmitter of the light barrier sensor, a plate 25 is supported on the sewing apparatus 23.

Figure 4:
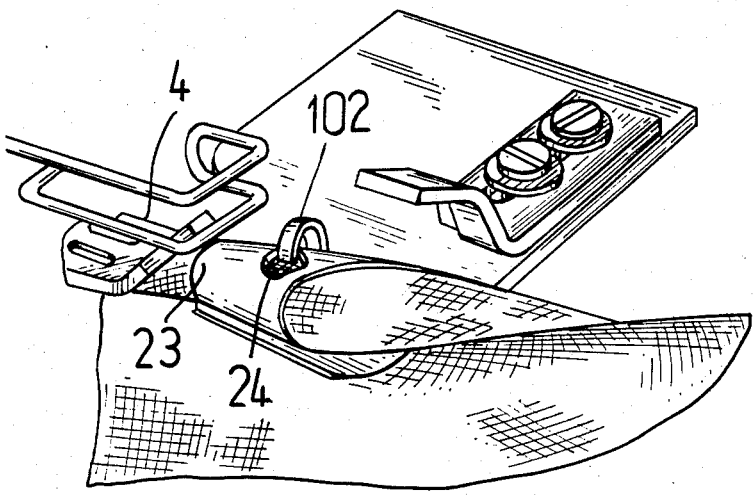
FIG. 4 is a fragmentary view corresponding to the right end of FIG. 3 showing an alternate form 102 of the sensor 2 of FIG. 3.

The sensor 2 has the primary function of detecting the edge of the sewn material. While a photo responsive 2 sensor is shown, this may be replaced by other sensors such as the mechanical feeler of sensor 102 (FIG. 4) mounted in any suitable position to respond to and signal the passing of an edge of the material being sewn. The remote side of the folding guide 23 may carry the sensor 102 in a manner which will not interfere with finger manipulations. The light intercepting number 25 will not then be necessary.

Just downstream of the sewing place 4, there is an ordinary commercial scissors which is actuated by external power. The blades 6, 7 of the scissors are swingably mounted on a pin 8 which is mounted either vertically or generally vertically, i.e. inclined. A pressure fluid activated cylinder 27 connected with the scissors moves it transversely across the direction of transport of the sewn material toward the cutting place. The scissor blades 6, 7 move to cut the continuous thread chain 32. If the scissor blades 6, 7 are mounted for swinging on a vertical pivot pin 8, then the pressure fluid cylinder 27 moves the scissors horizontally toward the cutting place. The scissors shown in FIG. 1 are mounted in the scissors housing 5. The pin 8 there is arranged inclined. As a result, the scissor blades 6, 7 move obliquely downward toward the cutting place.

Downstream of the presser foot 9, there is a holder 10, which is mounted for vertical displacement caused by a single-acting or double-acting cylinder 18, which can be acted on by pressure fluid. The holder 10 includes an open cutout 11, which extends transversely to the direction of transport of the sewn material and which opens toward the scissors. A needle plate 26 extends below the sewn material from upsteam of the sewing place downstream toward the cutout 11. The sewn part rides over the plate 26. The holder 10 is so located that the rear edge 28 of the needle plate 26 does not extend beyond the front edge, which is the trailing or upstream wall 29 of the cutout 11. The part of the lower surface of the holder 10 which is located upstream of the cutout 11 is pressed down against the needle plate 26. However, if no sewn part is present between them, there is a space between the part of the lower surface of the holder 10 which is located downstream of the rear edge, which is the leading or downsteam wall 36 of the cutout 11 and the top of the machine supporting bed plate 30. This enables the sewn part downstream of the cutout to be pulled upstream, while the upstream part is held still, as described further below.

There is a hook 12 which is centered along and extends along the cutout 11 and which is mounted for vertical displacement. The hook is moved up and down by external power, preferably by a single-acting or double-acting cylinder 19 which can be acted on by pressure fluid. The vertical motion of the hook is limited by stops 13, 14 which are adjustable vertically. The hook 12 comprises a vertically directed arm which is supported laterally by a support 31. The hook also includes a bar 15, which is directed horizontally and extends transversely to the direction of transport of the sewn material over the cutout 11. Upon vertical movement of the hook, the bar 15 passes through the cutout 11 in the holder 10. That edge of the bar 15 which is directed upward is provided with sawtooth-like notches which prevent lateral sliding off of the thread chains 32 wrapped over the bar 15.

A transport roller 16 downstream of the holder 10 is driven by a known transmission through an intermittently moved driven shaft 17. The transport roller 16 cooperates with a known type of lower feed dog 37 of the sewing machine 20 to press against the sewn material during transport of the sewn material. The transport roller 16 may be brought temporarily into an inactive, slightly raised position. The feed dog 37 is of the type which moves forward in the upraised condition and drops as it moves in the return direction.

In other embodiments of the invention, a mechanically operating feeler or a feeler acted on by pressure fluid can alternatively be used as sensor 2. This feeler can be an air barrier or a pneumatic contact-less signal transmitter. Furthermore, in alternatve embodiments of the invention, correspondingly operating electromagnets can also be used instead of the cylinders 18, 19, 27 which are acted on by pressure fluid.

Figure 2:
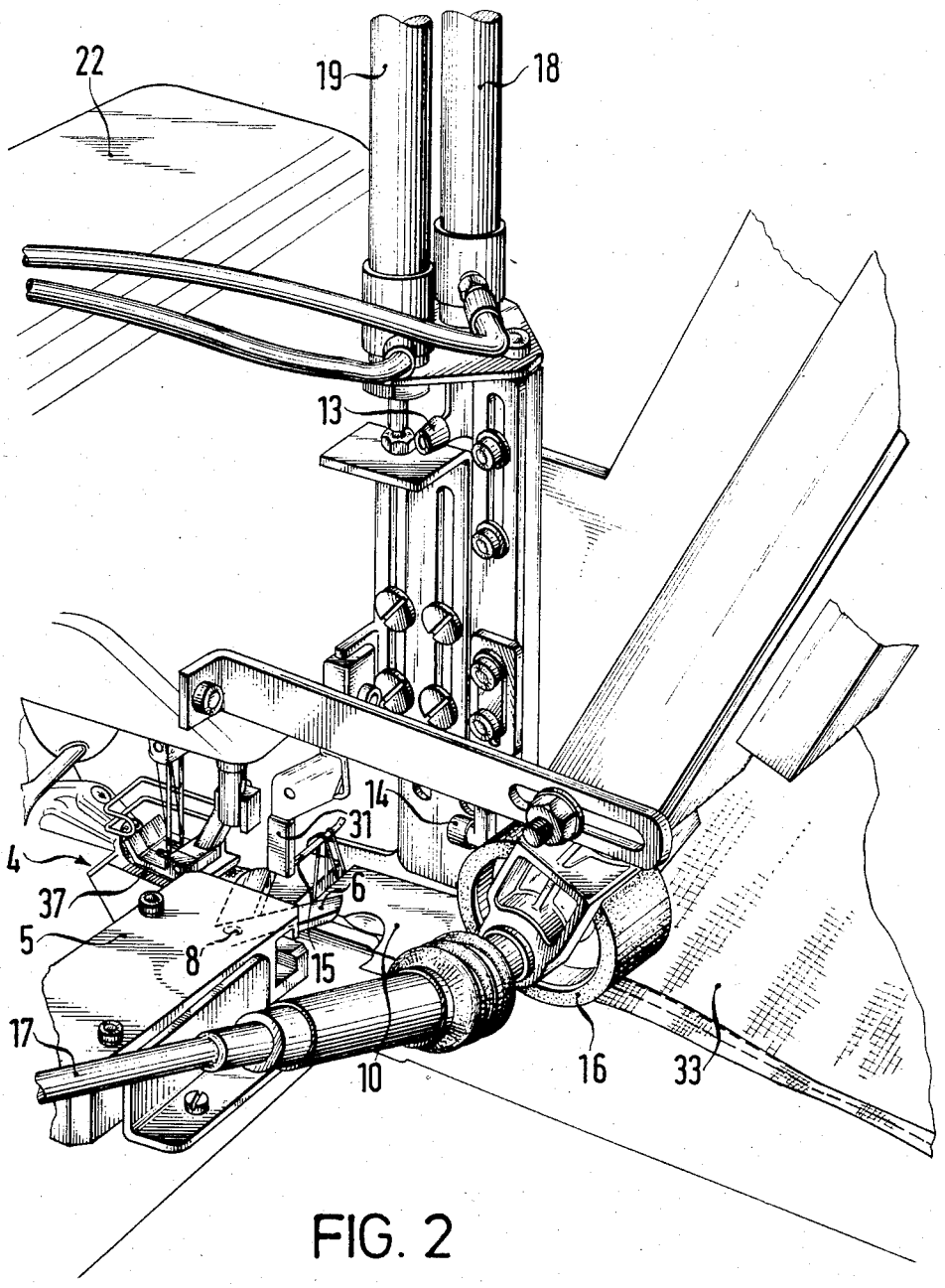
FIG. 2 is a perspective view of the cutting device looking at the rear of the arm head of the sewing machine.
Figure 3:
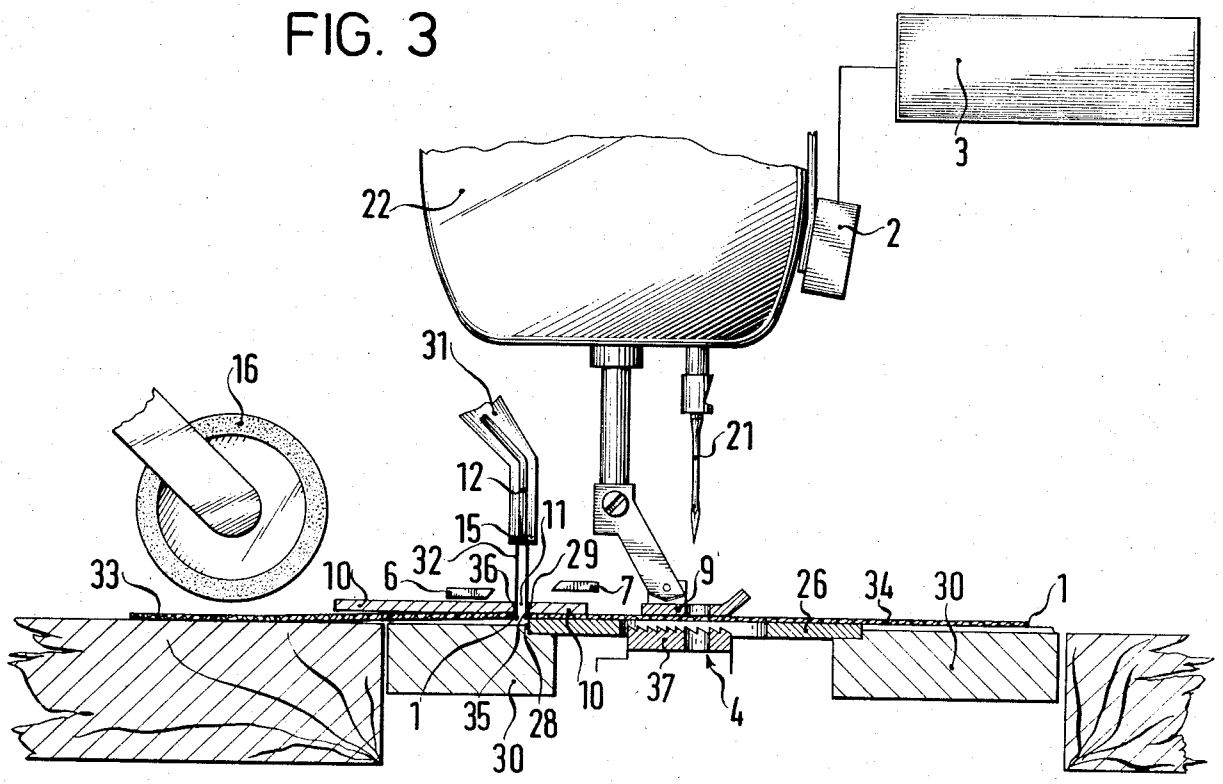
FIG. 3 is a simplified sectional view from which the interaction of the structural parts forming part of the cutting device can be noted, and the sewing apparatus not having been shown.

In order to show the cutting device and its individual parts more clearly, a finger guard which forms part of the cutting device has not been shown in FIGS. 1 to 3. That guard is intended to prevent danger of injury to the fingers of the operator.

The manner of operation of the above cutting device is now described. If the sewing needle or needles 21 are in their low or down position after the completion of the sewing process, then that sewn part 33 which is to be sewn next and which has been previously introduced into the sewing apparatus 23 is pushed forward until it comes to a stop against the sewing needle 21. This provides an accurately defined starting position with respect to the sewing process which follows.

When sewing commences, the stitch counter 3 is started. After a preselected number $n_1$ of stitches, the counter interrupts the sewing process. The number of $n_1$ stitches is selected to assure that the leading edge 35 of the sewn material does not protrude beyond the front edge 29 of the holder 10.

The holder 10, which had been in its raised position, is now lowered onto the sewn part 33. At the same time, the transport roller 16 is lifted slightly. The hook 12, which had been in its lowered position, is lifted into its raised position. Then the scissor blades 6, 7 are moved towards the cutting place as they are closing. However, because this is the first part 33 that is being sewn, there is no sewn connection to a preceding part on the first sewn part. Therefore, the scissors do not cut anything, and they return into their starting position.

Now, the transport roller 16 moves down again onto the sewn part 33 and the hook 12 is lowered into its lower position. At the same time, the holder 10 is raised into its high position. Finally, the interrupted sewing process is continued until the sensor 2 detects the trailing edge 1 of the sewn material.

The stitch counter 3 is again started, and this makes it possible to sew a preselected number of stitches $n_2$ after the detection of the trailing edge 1 of the sewn material, and then the sewing process is again terminated. By the over-sewing of the edge 1 of the sewn material, a thread chain 32 is produced on the sewn part 33. The following sewn part 34 is placed against the sewing needle 21, which is again in its low position.

From the start of the next sewing process, the said $n_1$ stitches are again sewn and the sewing process is thereupon interrupted. As described above, the holder 10 is next lowered. As a result, the sewn part 34 is clamped between the holder 10 and the needle plate 26. At the same time, the transport roller 16 is raised.

The hook 12 is in its lower position and the thread chain 32 which has been formed passes over the bar 15 of the hook. The hook is raised into the high position. As a result, the thread chain 32, as shown in FIG. 3, is pulled upward in the following manner. The leading sewn part 33, which is held unclamped between the lower surface of the holder 10 and the top of the bed plate 30, is pulled backward until its sewn material edge 1 is approximately flush with the leading edge 36 of the cutout 11. The trailing sewn part 34 is held stationary. The scissors, which now moves in the direction toward the cutting place, cuts the two upraised arms of the upward-pulled thread chain 32 with a single cut made just above the upper edge of the holder 10. Because of the location of the leading edge 35 of the part 34 at one side of the opening 11 and the trailing edges of the part 33 at the other side of the opening 11, the single cut is quite close to both of the sewn parts.

The transport roller 16 again drops onto the sewn part 33, the hook 12 is lowered into its low position, and the holder 10 is brought into its high position. The sewing process, which was previously interrupted, is continued until the sensor 2 detects the trailing edge 1 of the following sewn part. The cutting of the thread chain which now follows proceeds in the same manner.

Although the present invention has been described in connection with a preferred embodiment thereof, many variations and modifications will now become apparent to those skilled in the art. It is preferred, therefore, that the present invention be limited not by the specific disclosure herein, but only by the appended claims.

What is claimed is:

1. A cutting device for a sewing machine for cutting a thread chain, which said thread chain connects two successive sewn parts which are moving along a path through the sewing machine; the sewing machine including a sewing needle and including means for moving the needle to sew said parts, and the needle operates at a sewing place in the sewing machine;

the cutting device comprising cutting means supported on the sewing machine, and the cutting means being movable generally in a direction transversely across the path of the sewn parts; the cutting means being shaped and the motion thereof being oriented to cut the thread chain close to the adjacent edges of successive sewn parts;

the cutting device further comprising a sensor upstream in the path from the sewing place for scanning the parts to be sewn which are moving past the sensor for detecting an edge of one of said parts moving past the sensor;

a needle stitch counter connected with the sensor for being started in operation upon the sensor signaling that it has scanned an edge of a sewn part; the stitch counter being connected with the sewing machine for halting further sewing needle operation following a preset number of stitches by the sewing needle;

downstream of the sewing place, a sewn part holder being disposed at the path of sewn parts and being adapted for holding the sewn parts; the holder being shaped to include a cutout opening which extends transversely across the path of the sewn parts, and the cutout being defined by a downstream wall of the cutout in the holder which trails the opening along the path of travel of the sewn parts and by an upstream wall of the opening of the holder which leads the opening along that path; the cutting means being disposed for movement across the path of the sewn parts and along the cutout in the holder;

a thread engaging hook; means for supporting and for moving said hook up and down and across the path of the sewn parts, and the hook being movable through the cutout; the hook having an engaging part for engaging the thread chain, which is then at the cutout upon upward motion of the hook through and then above the cutout;

sewn material transport means downstream in the path of the sewn parts from the cutout for engaging a sewn part, and the transport means including an intermittent drive for imparting intermittent drive motion along the path of travel upon the sewn parts traveling past the transport means.

2. The cutting device of claim 1, wherein upstream of the cutout, the holder is movable against the sewn part which is then upstream of the cutout in the holder for the holder to firmly hold that sewn part against moving along the path of travel of the sewn parts as the hook is raised, while downstream of the cutout in the holder, the holder is shaped to permit the sewn part then downstream of the cutout to be shifted upstream toward the downstream wall of the cutout as the hook is raised, for thereby bringing the adjacent edges of the sewn parts then at the cutout closer together for the subsequent cutting.

3. The cutting device of claim 2, wherein the holder comprises a lower surface which faces down toward the sewn parts for pressing upon the sewn parts; support means below the sewn parts for supporting the parts in the path of travel and for supporting said parts against the pressing thereupon of the holder.

4. The cutting device of claim 1, further comprising a sewn part presser foot located upstream of the holder for pressing upon the sewn part then there, and means cooperating with the presser foot for engaging the sewn part there for intermittent advancement along the path of travel in cooperation with the presser foot.

5. The cutting device of claim 1, further comprising adjustable height stops for the hook for adjusting the height of raising of the hook above the cutout.

6. The cutting device of claim 1, wherein the cutting means comprises a scissors, the said scissors comprising a pair of scissor blades and a pivot pin on which the blades are supported, the pivot pin having an orientation generally toward the vertical, and the pivoting together of the scissor blades being for cutting the thread chain.

7. The cutting device of claim 1, wherein the transport means comprises a roller for contactng sewn parts and comprises means for intermittently rotating the transport means roller in engagement with the sewn part for moving that part along the path of the sewn parts.

8. The cutting device of claim 1, wherein the holder is movable up and down above the sewn parts in a direction across the path of travel.

9. The cutting device of claim 1, wherein the sensor is adapted for detecting the trailing edge of a sewn part moving therepast.

10. The cutting device of claim 1, wherein the sensor comprises a light barrier which shines toward the sewn parts and comprises means for detecting the change in the light as the edge of a sewn part moves past the light barrier.

11. The cutting device of claim 1, wherein the sensor comprises a feeler for detecting the edge of a sewn part moving therepast.

12. The cutting device of claim 1, further comprising pressure fluid means connected with the hook for moving the hook up and down.

* * * * *